US006042244A

United States Patent [19]

Witkoski

[11] Patent Number: 6,042,244

[45] Date of Patent: Mar. 28, 2000

[54] LIGHTED DISPLAY SYSTEM

[76] Inventor: William Witkoski, 41 Grove St., Naugatuck, Conn. 06770

[21] Appl. No.: 09/017,635

[22] Filed: Feb. 2, 1998

[51] Int. Cl.[7] ..... F25D 27/00; A47F 11/10

[52] U.S. Cl. ..... 362/133; 362/125; 362/226; 362/394

[58] Field of Search ..... 362/125, 133, 362/394, 226; 312/237

[56] References Cited

U.S. PATENT DOCUMENTS

| | | | |
|---|---|---|---|
| 1,497,728 | 6/1924 | Kresh . | |
| 1,532,935 | 4/1925 | Patton | 362/133 |
| 1,567,474 | 12/1925 | Tomlinson . | |
| 4,689,726 | 8/1987 | Kretzschmar . | |
| 4,799,133 | 1/1989 | Strzalko et al. | 362/133 |
| 5,034,861 | 7/1991 | Sklenak et al. . | |
| 5,163,745 | 11/1992 | Zagata . | |
| 5,690,415 | 11/1997 | Krehl | 362/133 |

*Primary Examiner*—Thomas M. Sember
*Attorney, Agent, or Firm*—Bachman & Lapointe, P.C.

[57] ABSTRACT

A lighted display system includes a housing; a power supply member disposed on the housing; a shelf member adapted for positioning within the housing and having a substantially internal passage; at least one light member mounted to the shelf member; at least one contact member mounted to the shelf and positioned to contact the power supply when the shelf is positioned in the housing; and wiring disposed in the internal passage and electrically connecting the light member and the contact member.

13 Claims, 2 Drawing Sheets

LIGHTED DISPLAY SYSTEM

BACKGROUND OF THE INVENTION

The invention relates to a lighted display system and, particularly, to a lighted display system having embedded wiring and modular assembly so as to provide a versatile and attractive system.

A continuous need exists for effective manners of displaying objects on shelves, in cabinets, and in other areas. In the field of retail, it is desirable to display products in an effective and attractive manner which draws consumer attention to a particular area. Existing systems for providing a lighted or illuminated display involve numerous wires, connectors, and the like which are visible and which detract from the effectiveness of the display.

It is therefore the primary object of the present invention to provide a lighted display system wherein wiring is embedded within the system and, therefore, not visible.

It is a further object of the present invention to provide a lighted display system which is substantially modular and, therefore, extremely versatile.

It is still another object of the present invention to provide a lighted display system having a connector assembly which provides for simple and effective positive connection of light fixtures with a power source.

Other objects and advantages of the present invention will appear hereinbelow.

SUMMARY OF THE INVENTION

In accordance with the present invention, the foregoing objects and advantages have been readily attained.

According to the invention, a lighted display system is provided, which system comprises: a housing; a power supply member disposed on the housing; a shelf member adapted for positioning within the housing and having a substantially internal passage; at least one light member mounted to the shelf member; at least one contact member mounted to the shelf and positioned to contact the power supply when the shelf is positioned in the housing; and wiring disposed in the internal passage and electrically connecting the light member and the contact member.

BRIEF DESCRIPTION OF THE DRAWINGS

A detailed description of preferred embodiments of the invention follows, with reference to the attached drawings, wherein.

DETAILED DESCRIPTION

The invention relates to a lighted display system for effectively and efficiently providing illuminated display of articles such as products, books and the like on shelves of a cabinet unit or similar structure.

Figure 1:
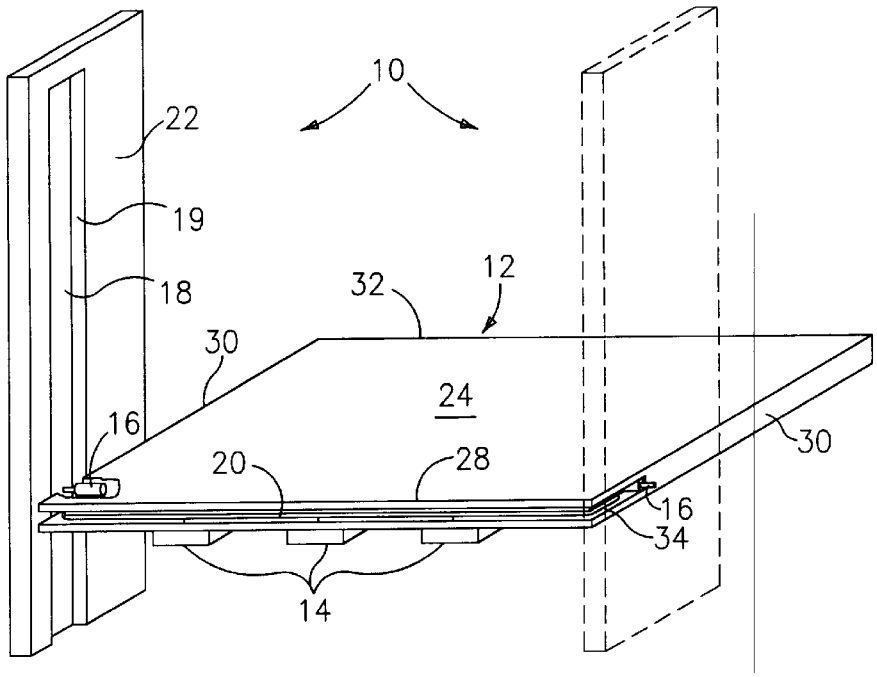
FIG. 1 is a perspective partially sectional view of a portion of a display system in accordance with the present invention.

Referring to the drawings, FIG. 1 illustrates a portion of a cabinet including a housing 10, a shelf 12, a number of lights 14 connected to shelf 12, a number of contact members 16 mounted on shelf 12, a power supply strip 18 positioned on housing 10, and wiring 20 schematically illustrated for electrically connecting lights 14 with contact members 16.

As indicated in FIG. 1, shelf 12 is preferably adapted for mounting or positioning within housing 10 so as to support various articles or objects thereon. Various holding structure (not shown) is preferably provided so as to hold shelf 12 in position within housing 10 as desired and as is well known to one of ordinary skill in the art. When positioned within housing 10, shelf 12 is positioned such that contact member 16 contacts power supply strip 18 so as to provide power to lights 14 as desired. As shown in FIG. 1 and also in FIG. 6, power supply strip 18 is preferably set back from or positioned in a groove 19 in the inside surface 22 of housing 10 so that contact member 16 can extend into groove 19 for secure contact against strip 18 as desired. Strip 18 is preferably positioned extending along at least a substantial portion of housing 10 so that one or more shelves 12 can be positioned within housing 10 at a variety of desired heights.

Figure 2:
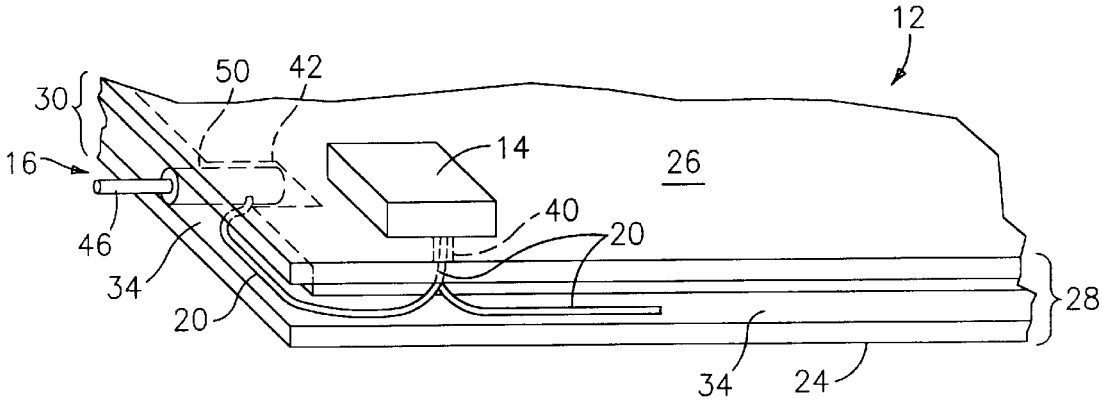
FIG. 2 is a perspective partially sectional view of the bottom side of a shelf element of a system in accordance with the present invention.

FIG. 2 shows an enlarged portion of shelf 12 in an inverted position so as to better illustrate certain portions of the system in accordance with the present invention. As shown, shelf 12 is preferably a substantially planar member having opposed surfaces including top surface 24 and bottom surface 26, and edges including a front edge 28, side edges 30 and a rear edge 32 (see FIG. 1).

Still referring to FIG. 2, shelf 12 is preferably provided with structure defining a substantially internal passage 34 or recess for receiving wiring 20 as desired. As shown in FIG. 2, passage 34 may suitably be provided by forming a recess along at least one edge 28, 30, 32 of shelf 12 which recess or passage 34 is preferably of sufficient size to at least partially, and preferably completely receive wiring 20 as shown.

Figure 3:
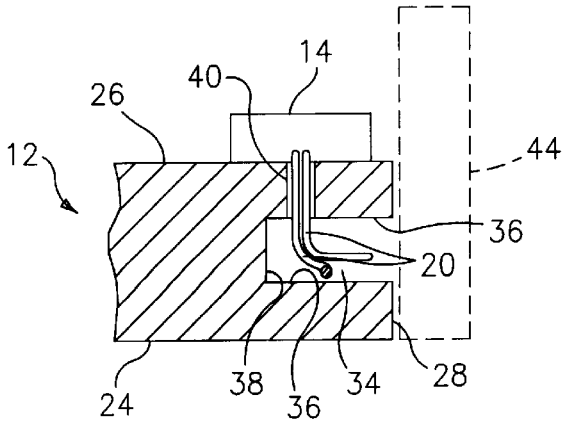
FIG. 3 is a side sectional view of a portion of the shelf of FIG. 2.

Referring also to FIG. 3, recess or passage 34 may suitably be a groove positioned along one or more edges 28, 30, 32 and defined between top and bottom recess walls 36 and an inner recess wall 38. Shelf 12 is also preferably provided with cutouts or apertures 40 defined through shelf 12 so as to communicate recess or passage 34 with lights 14 preferably mounted on bottom surface 26 of shelf 12. In this way, wiring 20 can advantageously be conveyed from contact members 16 through passage 34 and apertures 40 to lights 14 while being positioned entirely within passage 34/apertures 40 so as to advantageously conceal all wiring associated with the system of the present invention.

Shelf 12 may also suitably be provided having one or more wells, preferably positioned along side edges 30 of shelf 12, for receiving contact member 16 substantially aligned with recess or passage 34. As shown, wiring 20 may suitably be connected with contact member 16 within well 42 if desired.

Although FIG. 2 shows only a single light 14 and a single contact member 16, it should readily be appreciated that a series of lights 14 is contemplated as shown in FIG. 1, and any number of lights provided with the system of the present invention should be construed as well within the scope of the present invention. Furthermore, although FIG. 2 shows only a single contact member 16, it should be appreciated that each shelf 12 preferably has two contact members 16 extending from opposite side edges 30, as shown for example in FIG. 1. In addition, although only a single shelf 12 is shown, the system according to the present invention includes the use of as many shelves as may be desired for a particular display.

Still further, referring to FIG. 3, shelf 12 is preferably provided having a front plate 44 mounted over recess or passage 34 substantially as shown so as to completely enclose wiring 20, especially from viewing toward the front of shelf 12. Front plate 44 is shown in FIG. 3 in dashed lines so as to preserve clarity of the drawing, and shelf 12 is illustrated in an upside down relationship so as to correspond to the view of FIG. 2.

Figure 4:
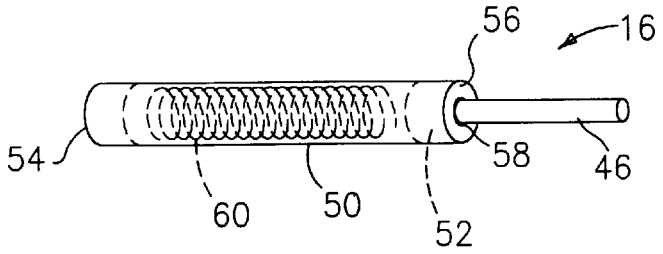
FIG. 4 illustrates a preferred connector for use in accordance with the system of the present invention.
Figure 5:
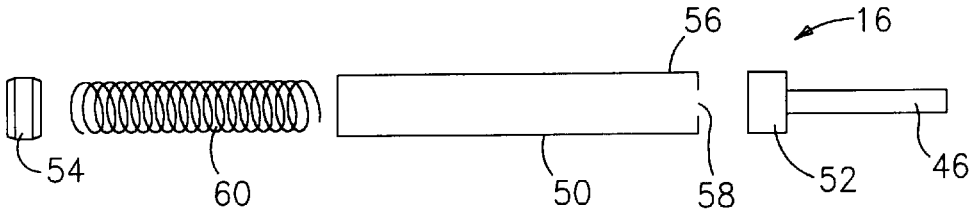
FIG. 5 is an exploded view of the connector of FIG. 4.

Referring now to FIGS. 4 and 5, contact members 16 preferably include a contact post 46 which is biased outwardly, toward the extending position of FIG. 2, so as to engage power strip 18 in groove 19 of housing 10. Most preferably, contact members 26 include a cylinder or sleeve member 50, and contact post 46 has a head portion 52 sized to fit within sleeve 50, preferably with little clearance. A sleeve plug 54 is disposed at one end of sleeve 50. Cap 56 preferably has a sleeve cap 56 disposed at the other end of sleeve 50 and having an opening or aperture 58 through which contact post 46 extends, while head portion 52 is slidably received within sleeve 50 and held against complete exit from sleeve 50 by sleeve cap 56. Still as schematically shown, contact member 16 preferably further includes a spring or bias member 60 positioned between sleeve plug 54 and head portion 52 of contact post 46 so as to bias contact post 46 outwardly with respect to sleeve 50.

Figure 6:
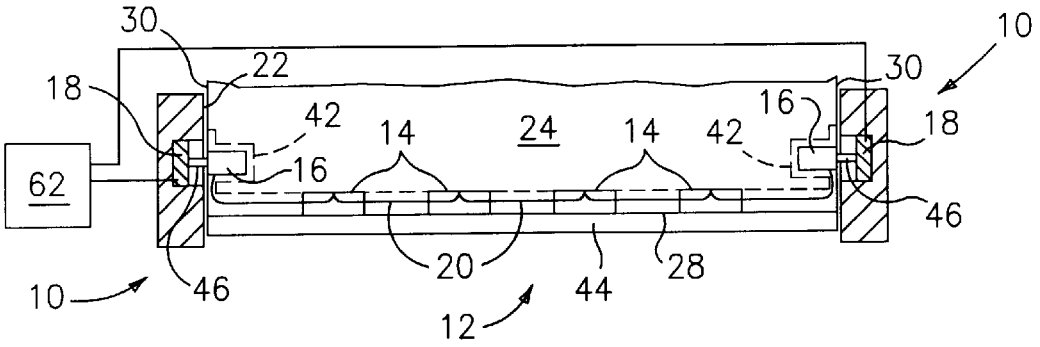
FIG. 6 is a top schematic view of a portion of the display system in accordance with the present invention.

Referring to FIGS. 2 and 6, contact members 16 are preferably mounted within wells 42 as shown and as described above.

Sleeve 50, sleeve plug 54, contact post 46 and head portion 52 are all preferably made of an electrically conductive material such that wiring 20 can be connected, for example through soldering, to sleeve plug 54 while contact post 46 communicates electrically with sleeve 50 through head portion 52.

Referring now to FIG. 6, a top schematic partially sectional view of a system in accordance with the present invention is shown wherein shelf 12 is mounted in housing 10, and shelf 12 includes four light members 14 connected in series by wiring 20, wherein wiring 20 is embedded within shelf 12, and further including contact members 16 extending from opposite side edges 20 so as to engage power supply strip 18 as desired. Further as shown, power supply strip 18 is preferably connected to a conventional low voltage transformer 62 or other source of power at suitable levels for operating lights 14 when shelf 12 is positioned within housing 10, for example as shown in FIG. 1.

Still referring to FIG. 6, it is clear that all wiring 20 is positioned embedded within shelf 12, in this embodiment along front edge 28 as well as both side edges 30, at least as far as the position of contact members 16.

In accordance with the foregoing, it should be readily appreciated that a system has been provided for simple, effective and attractive lighting or illumination of a display, wherein wiring is concealed and assembly is both simple and reliable.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A lighted display system, comprising:

a housing;

a power supply member disposed on the housing;

a shelf member adapted for positioning within the housing and having a substantially internal passage;

at least one light member mounted to the shelf member;

at least one contact member mounted to the shelf and positioned to contact the power supply when the shelf is positioned in the housing;

wiring disposed in the internal passage and electrically connecting the light member and the contact member; and a transformer member adapted to receive conventional voltage from a voltage source, to convert said conventional voltage to a lower voltage suitable for operating the light member, and to provide the lower voltage to the power supply member, wherein said contact member comprises an electrical contact post slidably mounted relative to the shelf and biased toward an extending position for contacting said power supply member, and a sleeve fixed relative to said shelf, said contact post being slidably received in said sleeve, and a spring member disposed in said sleeve for biasing said contact post at least partially out of said sleeve to a contact position.

2. A system according to claim 1, wherein the shelf member comprises a substantially flat member having opposed surfaces including a top surface and a bottom surface and edges including front, side and rear edges, and wherein the internal passage comprises a recess disposed along at least one of said edges.

3. A system according to claim 2, wherein said recess is disposed along said front edge, and further comprising a face member positioned on said front edge so as to enclose said wiring in said recess.

4. A system according to claim 2, wherein said light member is mounted on one surface of said opposed surfaces, and further comprising a cutout in said surface communicating with said recess, said wiring being connected to said light through said cutout.

5. A system according to claim 4, wherein said contact member is positioned along a side edge of said shelf, and wherein said recess extends along said side edge, said wiring being connected to said contact member through said recess.

6. A system according to claim 2, wherein said shelf member has at least one well positioned at said side edge for receiving said contact member, said well being substantially aligned with said recess.

7. A system according to claim 2, wherein said contact member is positioned between said surfaces.

8. A system according to claim 1, wherein said housing has two substantially parallel sides having opposed inner surfaces, wherein said power supply includes two opposed power supply elements positioned on said inner surfaces, wherein said shelf has two side edges aligning with said inner surfaces when said shelf is positioned in said housing, and wherein said contact member includes two contact elements positioned on said side edges for contacting said power supply elements when said shelf is positioned in said housing.

9. A system according to claim 1, wherein said contact post has a head portion disposed in said sleeve, and a post portion, and wherein said sleeve has a cap having an aperture, said head portion being larger than said aperture whereby said cap holds said contact post against removal from said sleeve.

10. A lighted display system, comprising:

a housing;

a power supply member disposed on the housing;

a shelf member adapted for positioning within the housing and having a substantially internal passage;

at least one light member mounted to the shelf member;

at least one contact member mounted to the shelf and positioned to contact the power supply when the shelf is positioned in the housing; and wiring disposed in the internal passage and electrically connecting the light member and the contact member, wherein said housing has two substantially parallel sides having inner opposed surfaces, wherein said power supply includes two opposed elongate power supply elements positioned on said inner surfaces, and wherein said shelf has two side edges aligning with said inner surfaces and said two opposed elongate power supply elements when said shelf is positioned in said housing, whereby said contact member contacts said two opposed elongate power supply elements, wherein said contact member comprises an electrical contact post slidably mounted relative to the shelf and biased toward an extending position for contacting said power supply member, and a sleeve fixed relative to said shelf, said contact post being slidably received in said sleeve, and a spring member disposed in said sleeve for biasing said contact post at least partially out of said sleeve to a contact position.

11. A system according to claim 10, wherein said elongate power supply elements each comprise a substantially smooth contact surface for contacting said contact member.

12. A system according to claim 10, wherein said side walls have grooves defined in said opposed surfaces, and wherein said two opposed elongate power supply elements are positioned within said grooves and facing each other, and wherein said contact member comprises contact elements extending outwardly from said side edges of said shelf to contact said two elongate power supply elements.

13. A system according to claim 10, further comprising a transformer member adapted to receive conventional voltage from a voltage source, to convert said conventional voltage to a lower voltage suitable for operating said light member, and to provide said lower voltage to said power supply member.

* * * * *